United States Patent [19]

Parnaby

[11] 4,203,831

[45] May 20, 1980

[54] 6/30 COAL WASHING PLANT

[76] Inventor: Derek Parnaby, Horsley Hall, Eastgate, Bishop Auckland, Durham, England

[21] Appl. No.: 918,432

[22] Filed: Jun. 23, 1978

[51] Int. Cl.[2] ..... B03B 7/00

[52] U.S. Cl. ..... 209/13; 209/211; 209/452

[58] Field of Search ..... 209/13, 17, 18, 2, 3, 209/12, 44, 211, 452, 451, 155, 10, 484, 488, 172.5, 173

[56] References Cited

U.S. PATENT DOCUMENTS

| | | | |
|---|---|---|---|
| 2,649,963 | 8/1953 | Fontein | 209/173 |
| 2,753,998 | 7/1956 | Hardinge | 209/172.5 |
| 3,887,456 | 6/1975 | Loughner | 209/211 |

*Primary Examiner*—Robert Halper

*Attorney, Agent, or Firm*—Frishauf, Holtz, Goodman & Woodward

[57] ABSTRACT

Raw coal is fed into the upper end of an inclined internally scrolled barrel. Washed coal is screened after leaving the barrel, and the material passing the screen is divided into two batches, the coarser being returned to the barrel, the finer being separated into coal and waste by cyclone separators. The outputs of the separators are dewatered to provide liquor for effecting washing of raw coal in the barrel via a launder pipe, and to provide fluid for circulation from the screen to the separators.

8 Claims, 2 Drawing Figures

6/30 COAL WASHING PLANT

This invention relates to improvements in coal washing plant.

BACKGROUND AND PRIOR ART

Coal washing plants are provided near mineheads in order to separate combustible coal from non-combustible and usually denser rock and shale.

A variety of apparatuses have been proposed for this purpose, including inclined rotating sieve screens, centrifugal washers, and inclined rotating barrels, all relying on some form of centrifugal classification of material in accordance with specific gravity.

The present invention relates to the inclined barrel type of coal washing plant. Essentially, the known plant comprises an elongate rotating barrel, the axis of which is inclined at about 15° to the horizontal. Raw coal is fed into the upper end of the barrel, and the coal is washed with wash water from a launder pipe. The material is classified so that shale and other dross leaves the barrel from the upper end, and concentrated coal at the lower end. The coal is sorted by a screen, through which fines fall, and water drains off, and the fines and water are recirculated into the top of the barrel.

The through put rate of such a plant is in the order of 20 tons per hour.

The invention: It is an object to increase the through put rate, so that a much larger quantity of coal can be washed, with a consequent increase in efficiency.

The coal washing plant comprises an inclined rotatable barrel, with means for feeding raw coal to its upper end, an outlet associated with the upper end for disposal of shale, a screen at the lower end for screening washed coal, means for removing the washed coal, the screen having a first finer region over a first wash liquor recovery tank, and a second coarser region over a second wash liquor recovery tank, the second tank having means for recycling wash liquor and fines to the barrel, and the first tank having means for feeding wash liquor and fines to a secondary separation stage preferably comprised by one or more cyclone separations.

The provision of a secondary, separation stage enables the through put of the barrel to be considerably increased, as the decreased efficiency of separation in a barrel working at a higher rate is compensated by the greater efficiency of the cyclone separator in separating coal fines when treating small volumes of borderline material from shale fines.

Two cyclone separators may be provided to be operated together or alternatingly in parallel, The separators discharge shale from one end, and coal from the other, and preferably the or each separator includes a vortex finder to enable an exact separation to be achieved.

Drawings illustrating an embodiment of the invention;

Figure 1:
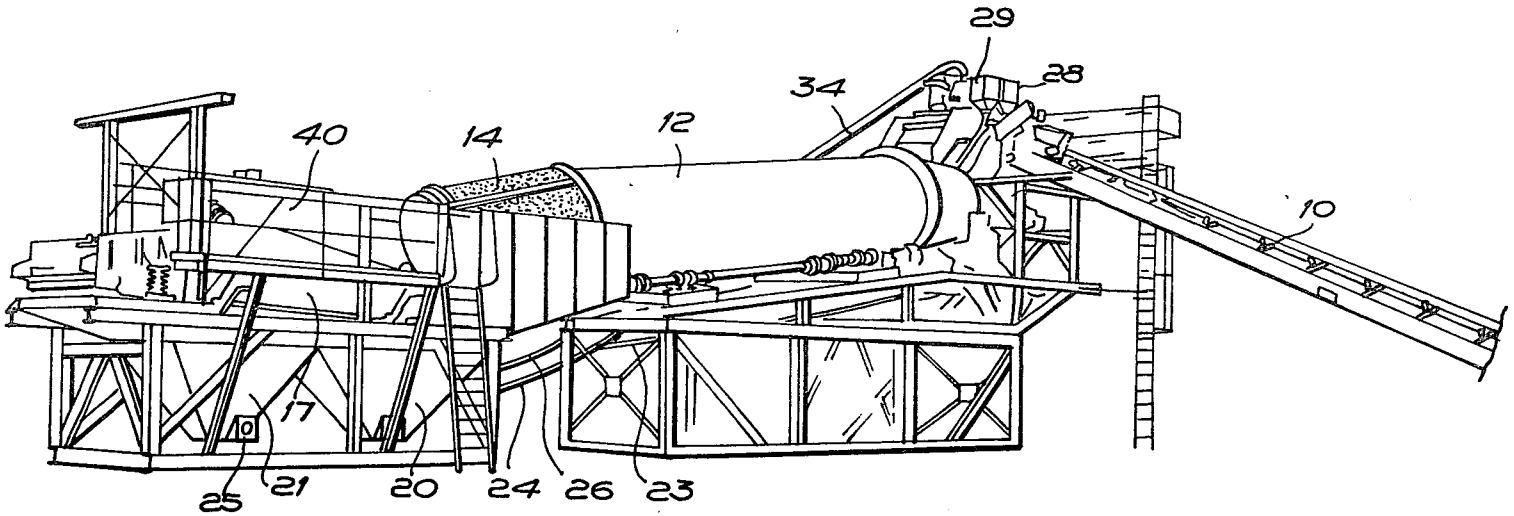
FIG. 1 is a perspective view of the plant.
Figure 2:
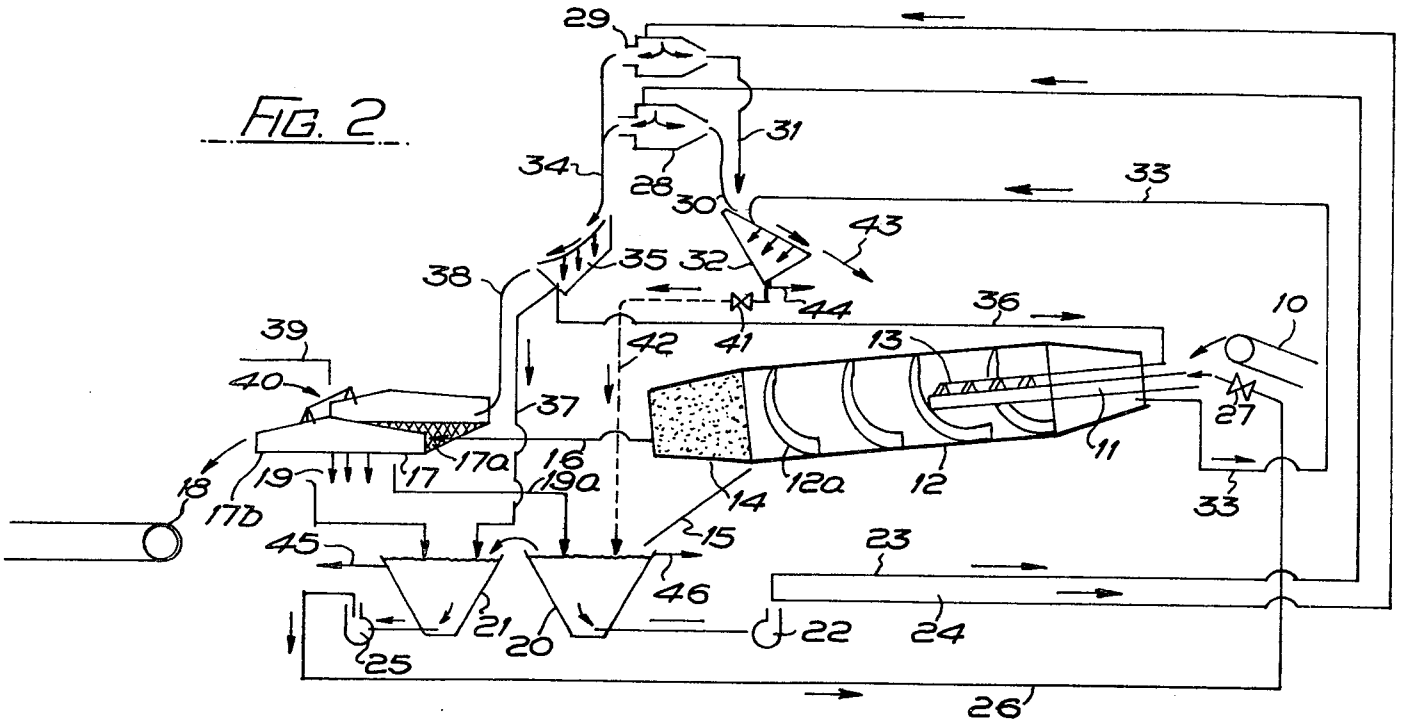
FIG. 2 is a flow diagram.

An inclined scrolled barrel 12 with a helical scroll or baffle 17, 12*a* inclined at an angle of about 15° is supported on piers 12*a*. Raw "dirty" coal is fed by a conveyor 10 into the upper end of the barrel 12, down a chute 11 (FIG. 2) while the barrel 12 is rotated to agitate the coal. The barrel 12 has a scroll 12*a* about 4 inches deep for advancing the shale. The coal in the barrel 12 is flooded with wash water fed by an axially extended launder pipe 13. Shale works upwardly against the flow and is discharged via a chute from the upper end of the barrel 12. The lower end of the barrel 12 has a perforate frusto conical region 14 which effects dewatering, liquor being channelled by chute 15 into tank 20. Coal is discharged at the lower end of the barrel at 16 onto a sifting and dewatering screen 17 which has two stages - a fine mesh 17*a* first, and a slightly coarser mesh 17*b* following the first stage. Water and fines flow through the screen 17 into two collecting tanks 20, 21 located below respective screen stages 17*a*, 17*b* Slurry from the second, or coarser stage collecting tank 21 is recycled by a slurry pump 25 via line 26 and valve 27 to the upper end of the barrel 12, to provide a first wash liquor which precedes the launder pipe wash.

Slurry from the first or finer stage collecting tank 20 is circulated by a slurry pump 22 in two parallel pipes 23, 24, to respective cyclone separators 28, 29. These can operate alternatively or together in parallel. The overflows 45 and 46 from the tanks run off as effluent.

The cyclone separators 28, 29 separate coal from dross and are each provided with adjustable vortex finders, so that the separators 28, 29 can be adjusted with regard to the specific gravities of coal and dross.

The shale from the separators 28, 29 is conducted off via lines 30 31 and passes over a dewatering screen 32, which dewaters the dross and discards it at 43. The water which is drained off lows out as effluent 44 or via valve 41 and line 42 to the first or fine stage tank 20. Shale from barrel 12 is also fed to screen 32 via a pipe 33. The coal from the separators 29, 28 taken off at line 34 is also dewatered, by passing over a dewatering screen 35. The liquor therefrom is channeled by line 36 to the launder pipe 13 for use in the second wash in the barrel 12 and to the second or coarse collecting tank 21 by line 37. After dewatering the coal is fed by line 38 to the same screen 17 as the output from the barrel 12 or by line 38*a* directly to conveyor 18. Coal from the screen 17 drops onto the conveyor belt 18 and is carried away for loading onto wagons or storage. Fine material and liquor are again recycled via tanks 21 and 20.

The cyclone separators 28, 29 provide a secondary wash stage, which by enabling a finer discrimination than the barrel 12, enables the barrel 12 to be operated with a higher volume throughput than heretofore, the cyclone separators 28, 29 being used for a more discriminating second stage wash of a small quantity of border line material, which could not be effected as effectively by the barrel 12 which operates at much lower speeds.

A third wash stage may be provided by feeding lighter material from the second tank 21 via a pipe to a further separator not shown, the discharges from which follow the same route as the discharges from the two separators 28, 29 above described.

I claim:

1. Coal washing plant comprising an inclined rotatably mounted barrel (12) having an internal helical scroll, (12*a*);

means (10) for feeding raw coal into the upper end of said inclined barrel;

means (11) introducing wash liquor into said barrel; outlet means (33) below said feed means and said wash liquid means at said upper end for disposal of unwanted materials therefrom;

sieve means (17) subsequent the lower end of said barrel for screening washed coal issuing from said barrel;

removal means (18) for removing washed coal after said screening from the top side of said sieve means;

at least one cyclone separator (28, 29);

said sieve means (17) having a first sieve region (17*a*) of relatively fine mesh and a second sieve region (17*b*) of coarser mesh;

a first collecting tank (20) disposed below said first fine mesh sieve region (17*a*);

a second collecting tank (21) disposed below said second coarse mesh sieve region (17*b*);

first pump means (22) for circulating particles and liquor passing through said fine mesh sieve region from said first tank to said at least one cyclone separator (28, 29);

second pump means (25) for circulating particles and liquor passing through said second coarse mesh sieve region (17*b*) to said upper end of said barrel;

means (34, 35, 38,) for feeding coal material separated by said least one cyclone separator to said removal means (18);

and means (30, 31, 32, 43) to remove material rejected by said at least one cyclone separator.

2. Coal washing plant according to claim 1, wherein said means (34, 35, 38) to feed coal material separates by said at least one cyclone separator includes a first dewatering screen (35), means (38) carrying particles from said first dewatering screen to said sieve means (17), and means (37) feeding liquor therefrom to said second collecting tank (21);

and wherein the means introducing wash liquor into said barrel includes a launder pipe (11) connected to said second pump means (25) and hence to second collecting tank, said launder pipe extending axially to said barrel (12), from the upper end to spray liquor on the coal just after it has been fed into said barrel.

3. Coal washing plant according to claim 2 wherein the means (30, 31, 32, 43) to remove material rejected by said at least one cyclone separator (28, 29) includes a second dewatering screen (32), means (43) removing particles from said second screen, and means (41, 42, 44) selectively discharging liquor from said dewatering screen as effluent or feeding said liquor to said collecting tank (20).

4. Coal washing plant according to claim 3, where in two cyclone separators (28, 29) are provided both being fed from said first collecting tank, (20) and selectively operable either together in parallel, or in alternation.

5. Coal washing plant according to claim 3, wherein said at least one cyclone separator (28, 29) has an adjustable vortex finder.

6. Coal washing plant according to claim 1 wherein two cyclone separators (28, 29) are provided both being fed from said first collecting tank, (20) and selectively operable either together in parallel, or in alternation.

7. Coal washing plant according to claim 1 wherein said at least one cyclone separator (28, 29) has an adjustable vortex finder.

8. Coal washing plant according to claim 1 wherein the means (34, 35, 38) to feed coal material separated by said at least one cyclone separator includes means carrying said separated coal material to said sieve means (17) for additional screening and subsequent removal by said removal means.

* * * * *